United States Patent [19]

Lee

[11] Patent Number: 4,991,468

[45] Date of Patent: Feb. 12, 1991

[54] BARREL TYPE SOCKETS

[76] Inventor: Clark J. Lee, 429-6 Chung Cheng Rd, Fu Liao Li, Tsao Tun Town, Nantou Hsien, Taiwan

[21] Appl. No.: 565,471

[22] Filed: Aug. 10, 1990

[51] Int. Cl.[5] ..... B25B 13/46

[52] U.S. Cl. ..... 81/60; 81/185

[58] Field of Search ..... 81/58, 59.1, 60–63.2, 81/124.4, 124.5, 124.7, 180.1, 185, 185.1, DIG. 11

[56] References Cited

U.S. PATENT DOCUMENTS

| | | | |
|---|---|---|---|
| 613,153 | 10/1898 | Kennelly | 81/185 |
| 1,123,612 | 1/1915 | Starks | 81/185 |
| 4,259,883 | 4/1981 | Carlson | 81/60 X |
| 4,308,768 | 1/1982 | Wagner | 81/60 |
| 4,939,961 | 7/1990 | Lee | 81/60 |

*Primary Examiner*—D. S. Meislin

*Attorney, Agent, or Firm*—Bacon & Thomas

[57] ABSTRACT

The present invention provides a socket comprising a barrel of uniformal polygonal cross section having an axial polygonal wrenching aperture at the center and a slant inward chamfer at the outer surface of each end of the barrel. The socket is detachably received by a driver wheel of a ratchet wrench, in which the driver wheel has a polygonal receiving hole corresponding to the polygonal barrel, and a pair of ring detents are mounted in the opposite openings of the receiving hole to elastically grip the socket at the chamfers respectively.

2 Claims, 4 Drawing Sheets

BARREL TYPE SOCKETS

BACKGROUND OF THE INVENTION

The present invention relates to sockets which can be detachably connected to a ratchet wrench for transmitting axial torque to a threaded fastener and more particularty to a feature for socket having a shape which renders its manufacture easy.

Known socket wrench sets normally comprise a reversible wrench having a square stud projecting from one side thereof, and a plurality of sockets having a square hole corresponding to the square stud at one end and a polygonal aperture for engaging with a threaded fastener at another end thereof. For tightening or loosening a threaded screw, one of said sockets having a polygonal aperture corresponding to the size of the screw is chosen to connected to the driving stud of the reversible wrench, and then the reversible wrench in combination with the socket is used to transmit axial torque to the screw. This type of socket is complicated in configuration, and thus add the cost of socket.

SUMMARY OF THE INVENTION

An object of the present invention is to provide a socket which can be detachably connected to a ratchet wrench and is easy in manufacture.

Another object of the present invention is to provide a socket wrench set containing a plurality of sockets which are easy in manufacture.

In carrying out the above objects, the socket which can be detachably connected to a ratchet wrench for transmitting axial torque to a threaded fastener according to the present invention is a barrel of uniform polygonal transverse section, in which the polygonal barrel has an axial polygonal wrenching aperture at its center and a slant inward chamfer at the outer surface of its respective ends.

The ratchet wrench suitable for detachably engaging the socket in present invention comprises a handle, a driver wheel rotatably mounted in one end of the handle having a polygonal receiving hole along an axis perpendicular to the handle, and ratchet means for connecting the driver wheel to rotate with the handle around said axis in only one direction, in which the polygonal receiving hole has a transverse cross section corresponding to the outer transverse cross section of said socket, and a polygonal broken ring detent having an inner opening which is large enough to receive the slant inward chamfer and at the same time is small enough to elastically grip the socket at this slant inward chamfer is disposed co-axially at each opening of the receiving hole of the driver wheel to provide the detachable connection between the socket and the driver wheel.

In one of the preferred embodiments of present invention the socket has an additional generally V-shaped peripheral groove on the outer surface and at the middle portion of the socket, and the driver wheel of the ratchet wrench has a corresponding C-shaped ring mounted at the middle portion of the inner wall of the receiving hole to detachably connect to the additional groove as the socket is inserted into the receiving hole of the driver wheel.

BRIEF DESCRIPTION OF THE DRAWINGS

In the various views, like reference numbers refer to like elements.

DETAILED DESCRIPTION OF THE PREFERRED EMBODIMENTS

Figure 1:
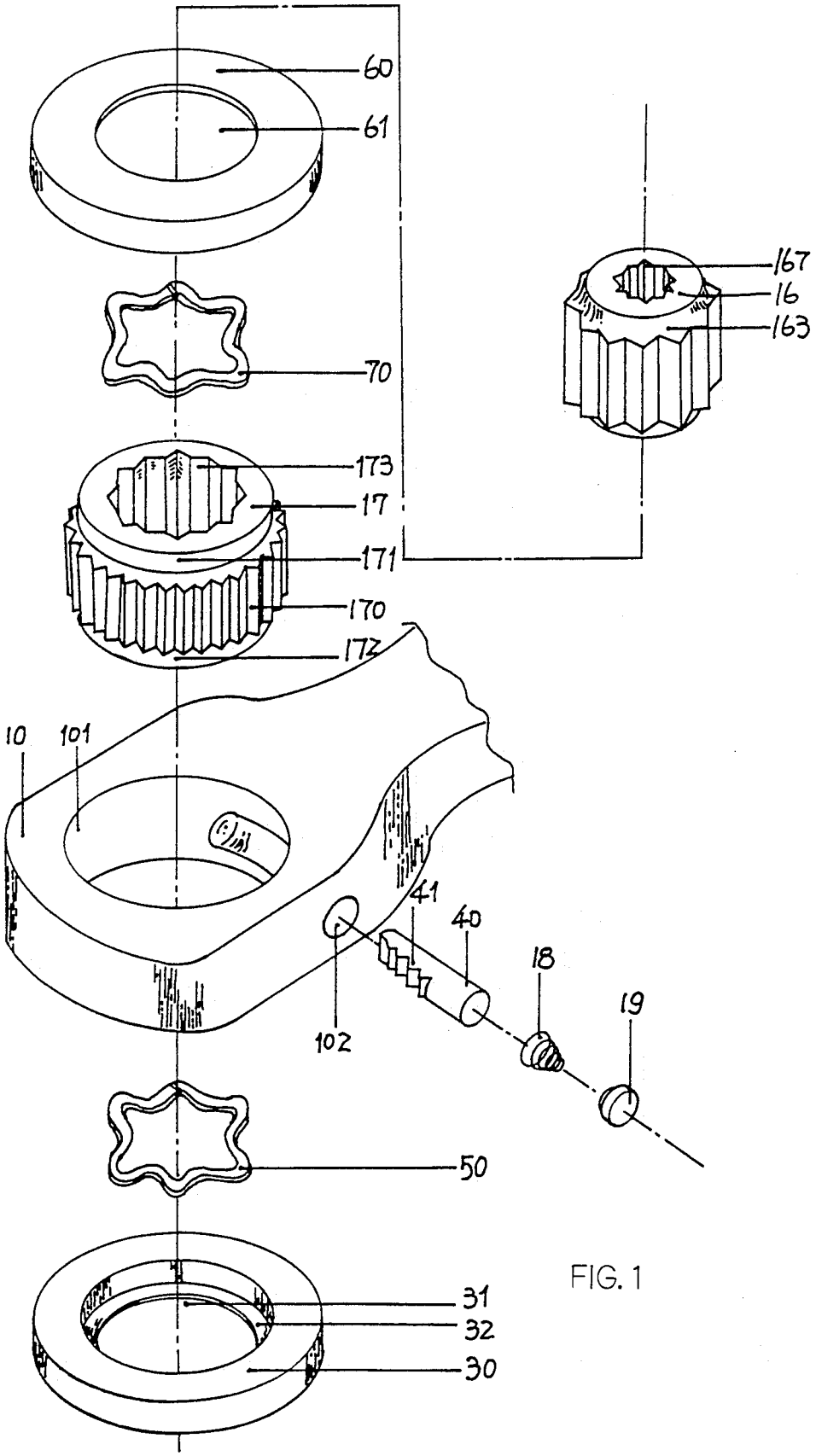
FIG. 1 is an exploded perspective view that illustrate the construction of a socket wrench according to the present invention.
Figure 2:
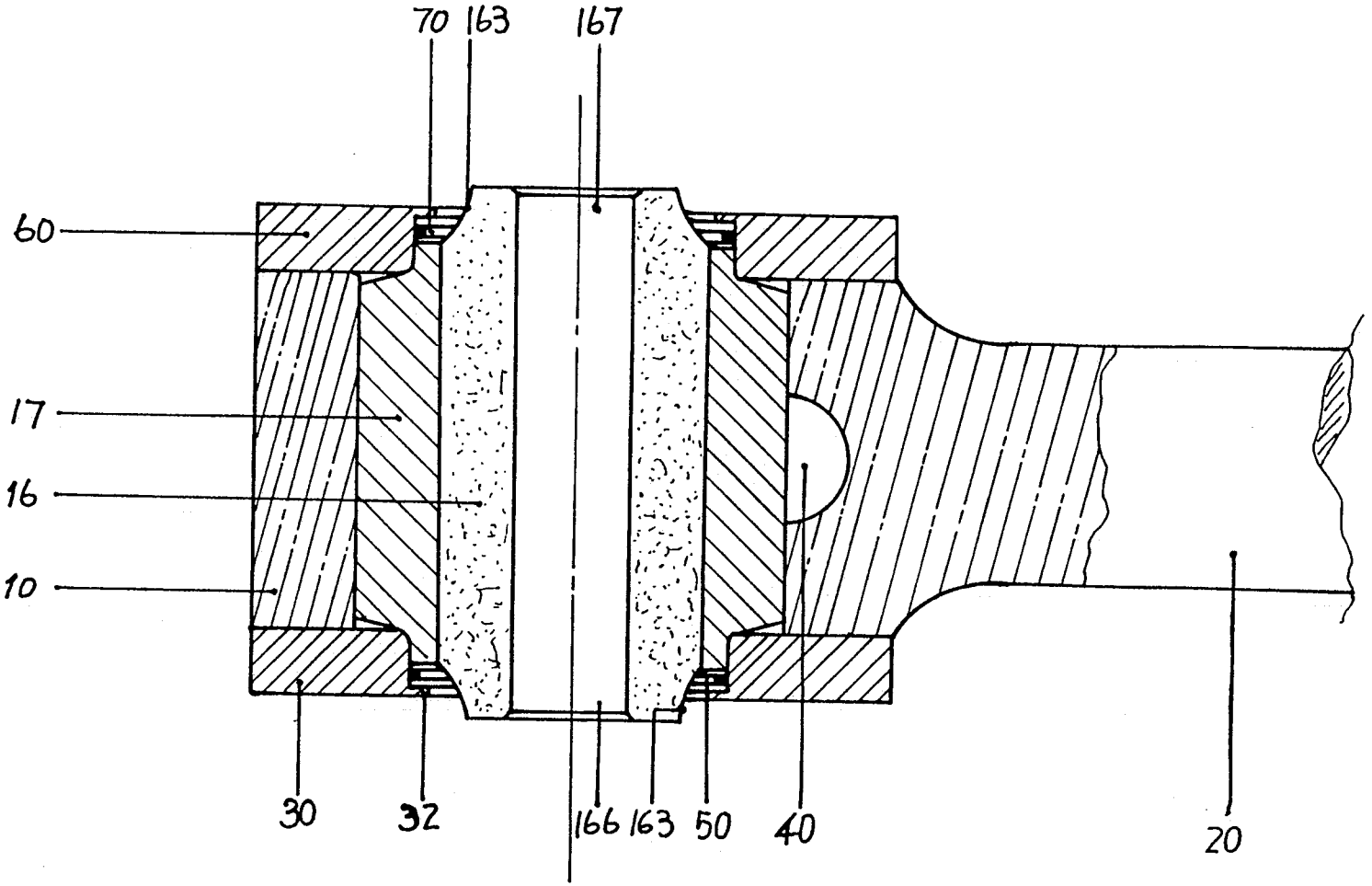
FIG. 2 is a longitudinal, vertical, sectional view of the socket wrench in FIG. 1.
Figure 3:
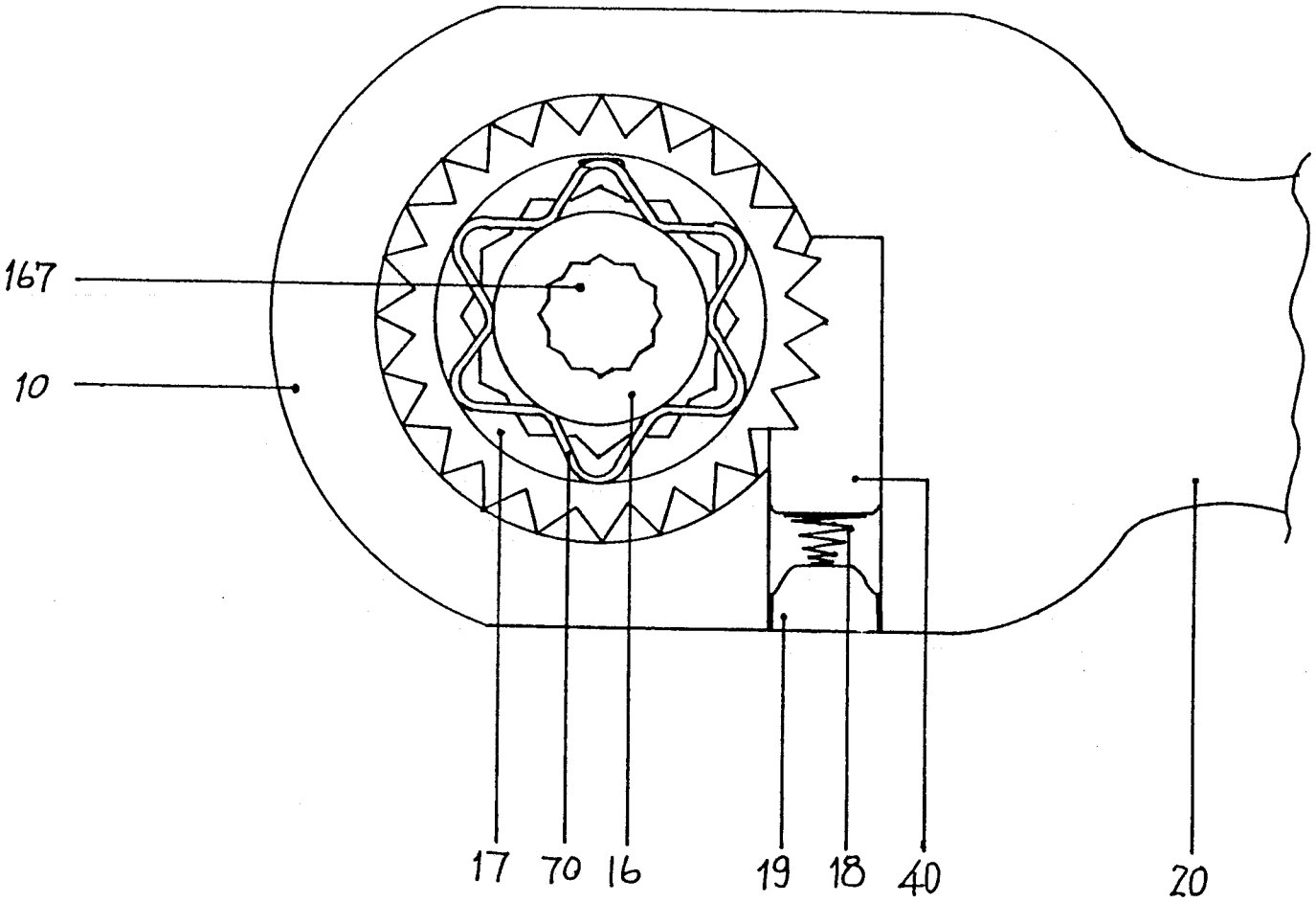
FIG. 3 is a longitudinal, horizontal, sectional view of the socket wrench in FIG. 1.

The present invention will be described in greater detail with reference to the accompanying drawings wherein several preferred embodiments of the present invention are set forth. One embodiment of the present invention is shown in FIGS. 1, 2 and 3 of the drawings. In this embodiment, a reversible wrench suitable for using in the present invention generally comprises a wrench body including a head 10 and a handle 20 extending therefrom, said head further providing a round driver housing 101. Driver housing 101 has an opening perpendicular to the handle 10, and a lateral hole 102 is penertated half way through the head and partially across the housing 101.

A pawl 40 having ratcheting teeth 41 is mounted inside the hole 102 with the opening of the hole 102 being sealed with a tiny plate 19. A compression spring 18 is bounded between the tiny plate 19 and the pawl 40.

A driver wheel 17 which has axial teeth 175 protruding outwardly on the outer surface and a polygonal hole 173 through its axial center portion is rotatably received in the driver housing 101 with its axial teeth 175 being in meshed engagement with the ratchet teeth 41.

A polygonal broken ring detent 50 which has as inner opening slightly smaller than the opening of the hole 173 is placed on the lower end of the driver wheel 17 and bounded by a cap 30.

The cap 30 which has a central hole 31 and a flange 32 protruding inward from the hole 31 is adapted to fixedly connected to a cylindrical portion 172 located on the lower end of the driver wheel 17, in which the polygonal broken ring detent 50 is seated between the flange 32 and the lower end of the driver wheel 17. Symmetrically to the cap 30 on the opposite side of a central dividing plane along the longitudinal direction of the handle 20, the cap 60 and the polygonal broken ring detent 70 are being mounted on the upper end of the driver wheel 17.

A typical example of sockets manufactured according to the present invention is shown in FIGS. 1 and 2. The socket 16 comprises a barrel of uniform polygonal transverse section having an axial polygonal wrenching aperture 167 therein, and a slant inward chamfer 163 at the outer surface of each end of said barrel. Due to the socket 16 having an uniform transverse section, the socket 16 can be easily manufactured by drawing a commercial available circular steel pipe through a polygonal die, cutting the drawed polygonal tube and chamfering its respective ends. As well known to those skilled in the art, this process is much easier and quicker than the forging or pressing process for producing the conventional square drive sockets.

As it is shown in FIGS. 2 and 3, the lower chamfer 163 has an outer diameter slightly smaller than the inner hole of the broken detent ring 70 such that the socket 16 can be pushed to insert into the broken detent ring 70. The detent ring 70 is then stretched by the polygonal portion of the socket 16, and finally elastically grips the upper chamfer 163 as the lower chamfer 163 is received and gripped by the broken detent ring 50. Consequently, the socket 16 retained by these detent ring 70, 50 can be removed therefrom by pushing either end of the socket 16 to pass through the polygonal hole 173 of the driver wheel 17.

A plurality of sockets which are similar to the socket 16 except that the sizes of the wrenching aperture 167 are varied to engage with different size threaded screws can be manufactured and used in the above-mentioned wrench.

When the handle 20 of the wrench as shown in FIG. 3 is rotated in a clockwise direction by an operator, the driver wheel 17 will be driven to rotate clockwise by the pawl 40 because the pawl 40 is bounded by the bottom end of the hole 102. When the handle 10 is rotated in a counterclockwise direction with the socket 16 fixed non-rotatably, the pawl 40 will depress the compression spring 18. Therefore, the socket 16 retained by the ratchet wheel 17 can be used to reversibly tighten or loosen a right-handed threaded screw depending on which sides of the socket being used to engage with the screw. Since the two sides of the socket wrench are of identical construction, the rotation of the driver wheel 17 can be changed from clockwise to counter-clockwise or vise versa, as used by the operator by merely inverting the wrench.

Figure 4:
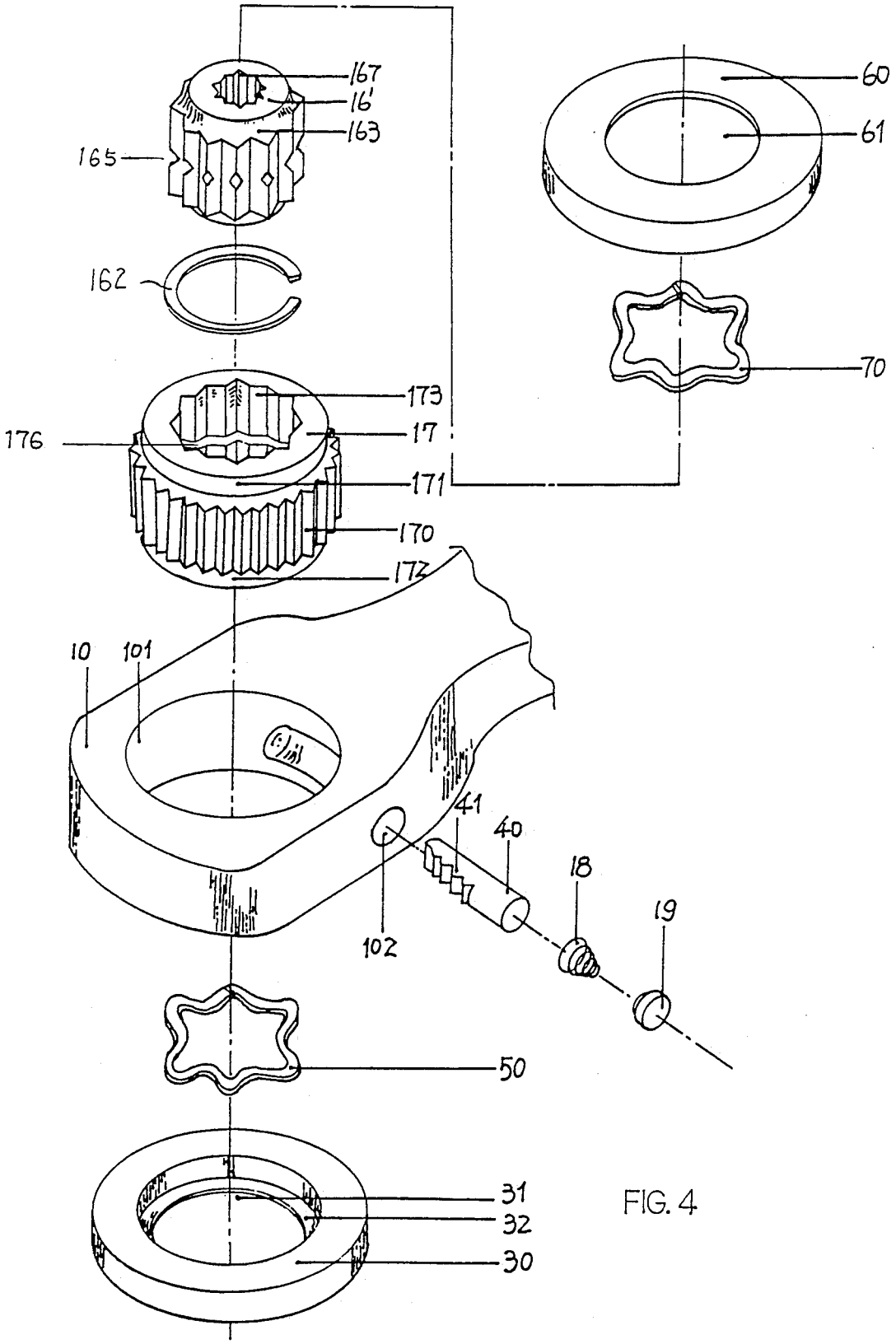
FIG. 4 is an exploded perspective view that illustrate the construction of a socket wrench which is similar to the socket wrench in FIG. 1 except an additional C-shaped ring 162 which is mounted in the receiving hole 173 to engage with an additional V-shaped groove 165 located on the outer surface of the socket 16.

An alternative embodiment is shown in FIG. 4. In this embodiment, a groove 176 having two vertical walls is provided at the middle of the wrenching aperture 173, and a C-shaped detent ring 162 is mounted therein, in which the C-shaped detent ring 162 has an inner diameter larger than the outer diameter of the chamfer 163 but smaller than the one of the polygonal portion of the socket 16', more importantly, the in-situ C-shaped detent ring 162 is allowed to be stretched to open as the socket 16' is inserted into the wrenching aperture 173. Corresponding to this C-shaped detent ring 162, an additional generally V-shaped peripheral groove 165 is provided at the middle portion of the outer surface of the socket 16'. When the socket 16' is inserted into the wrenching aperture 173, the C-shaped detent ring 162 is first stretched to open by the chamfer 163, and then connected to the V-shaped groove 176. By pushing either end of the socket 16', the C-shaped detent ring 162 will ride up on the slant wall of the V-shaped groove 176, and thus the socket 16' retained by the C-shaped detent ring 162 can be removed from the polygonal hole 173 of the driver wheel 17.

I claim:

1. In a socket wrench for transmitting axial torque to a threaded fastener which comprises a ratchet wrench comprising a handle, a driver wheel rotatably mounted in one end of the handle along an axis perpendicular to the handle, and ratchet means for connecting the driver wheel to rotate with the handle around said axis in only one direction, and a socket detachably connected to the driver wheel, wherein the improvement comprises:

(a) the socket comprising a barrel of uniform polygonal trannsverse section having an axial polygonal wrenching aperture at the center and a slant inward chamfer at the outer surface of each end of said barrel;

(b) the driver wheel having an axial polygonal receiving hole which is adapted to intimately receive the socket; and (c) a pair of ring detents, each of which have an inner diameter larger than the smallest diameter of the chamfer and smaller than the outer diameter of the polygonal barrel of the socket, and are connected co-axially to the opposite ends of the receiving hole of the driver wheel respectively, to elastically grip the chamfer on both ends of the socket respectively as the socket is received in the receiving hole of the driver wheel.

2. The socket wrench as claimed in claim 1, in which the socket further contains a V-shaped peripheral groove at the middle of the outer surface of the barrel, and a C-shaped ring having an inner diameter larger than the smallest diameter of the chamfer and smaller than the outer diameter of the polygonal barrel of the socket is mounted co-axially at the middle portion of the inner wall of the receiving hole to elastically grip the V-shaped peripheral groove as the socket is received in the receiving hole of the driver wheel.

* * * * *